United States Patent [19]

Gaston

[11] Patent Number: 5,007,230

[45] Date of Patent: Apr. 16, 1991

[54] SAFE PACKAGING FOR DETONATING CORD

[75] Inventor: Didier Gaston, Kourou, Guyana

[73] Assignee: Schlumberger Technology Corporation, Houston, Tex.

[21] Appl. No.: 475,664

[22] Filed: Feb. 6, 1990

[30] Foreign Application Priority Data

Feb. 8, 1989 [FR] France ..... 89 01617

[51] Int. Cl.[5] ..... B65B 63/04

[52] U.S. Cl. ..... 53/397; 53/430; 206/3; 206/389; 242/77.1

[58] Field of Search ..... 53/397, 430, 581; 206/3, 389; 242/77.1, 159, 166

[56] References Cited

U.S. PATENT DOCUMENTS

| | | | |
|---|---|---|---|
| 1,485,320 | 2/1924 | Wheeler | 242/77.1 |
| 1,509,123 | 9/1924 | Binder . | |
| 1,596,962 | 8/1926 | Geddes | 242/77.1 |
| 1,983,141 | 12/1934 | McFarland | 206/3 X |
| 2,349,946 | 5/1944 | Durr | 242/77.1 |
| 2,352,998 | 7/1944 | Alexander . | |
| 2,393,221 | 1/1946 | Mercer | 206/3 X |
| 4,326,631 | 4/1982 | Annand | 206/389 |
| 4,586,602 | 5/1986 | Levey | 206/495 |
| 4,895,249 | 1/1990 | Davis | 206/3 |

*Primary Examiner*—John Sipos

*Attorney, Agent, or Firm*—Henry N. Garrana; John H. Bouchard

[57] ABSTRACT

The invention relates to a method of packaging a detonating cord comprising explosive material contained in a sheath, intended to meet safety regulations of air transportation. The detonating cord is wound on a support in such a manner that every portion of the detonating cord in the winding is spaced apart from the nearest portions which are substantially parallel thereto by a distance (a) lying in a range between the distance below which detonation is transmissible from one portion to the nearest portion, and the distance beyond which said containing sheath is no longer destroyed by the detonation of (a) nearest portion.

2 Claims, 2 Drawing Sheets

SAFE PACKAGING FOR DETONATING CORD

The present invention relates to packaging detonating cord in such a manner that spontaneous detonation of the cord at one point does not propagate to the entire cord. The invention also relates to a support for implementing the method, and to the resulting package.

Explosive substances must be capable of being stored in complete safety and also of being transported quickly to sites such as oil production or exploration sites. They must be capable of being transported by air, in particular. International regulations define classes for explosive substances, and at present detonating cords are in a class for which air transport is banned. In general, when a detonating cord wound in a reel detonates, it detonates completely and produces major blast effects which are incompatible with air transport safety.

The invention seeks to provide a packaging method making it possible to prevent a local detonation from propagating. This packaging should be simple and inexpensive, unlike the packaging proposed in U.S. Pat. No. 4,586,602 where crossover points are established that interrupt the propagation of a detonation by virtue of separator means.

According to a first aspect of the present invention, there is provided a method of packaging a detonating cord comprising explosive material contained in a sheath, said method comprising the step of winding the detonating cord on a support in such a manner that every portion of the detonating cord in the winding . is spaced apart from the nearest portions which are substantially parallel thereto by a distance (a) lying in the range between the distance below which detonation is transmissible from one portion to the nearest portion, and the distance beyond which said containing sheath is no longer destroyed by the detonation of a nearest portion.

It has been discovered that for some cords, in particular transmission cords, the energy required for destroying the containing sheath is less than the energy required for igniting detonation. The invention is based on this discovery. In order to prevent detonation of a reel of cord as a whole, it is necessary firstly to prevent ignition propagating by the influence of the detonation of one strand, and secondly to interrupt the continuity of the cord in order to stop detonation propagating along the cord. This is achieved by the destruction of the containing sheath, which advantageously takes place at an energy threshold which is relatively low and which is far enough below the threshold that would lead to the detonation propagating by influence.

If the cord is wound in layers, the method of the invention advantageously includes a step of winding a spacer cord of inert material simultaneously with the detonating cord, said material forming intermediate turns between adjacent turns of detonating cord.

In a second aspect, the invention provides a safety support for making a reel of detonating cord, the support comprising two end plates spaced apart by at least two series of parallel strips, each series defining a support for one layer of the reel and positioning that layer such that each layer of the reel is substantially parallel to the adjacent layers and is spaced apart therefrom by a predetermined distance.

In one embodiment of this support, the strips are notched so as to fix the position of each turn in a layer and its distance from its neighbors.

For supports which can be recovered, the strips belonging to series other than the series constituting the support for the innermost layer are removably fixed to the side plates. In any event, a layer can only be wound in the absence of the strips for supporting layers further out than the layer being wound. Thus regardless of whether they are removably fixed or not, the strips must be installed while the reel is being wound.

With such a support, the turns of detonating cord in a layer are suitably isolated from one another by winding intermediate turns of a spacer cord. This cord may be made of plastic and preferably hollow i.e. tubular in cross-section. Its outside diameter will depend on the type of detonating cord being packaged. In general it will lie in the range 5 millimeters to 10 millimeters. Naturally, the substance from which the spacer cord is made (a plastic) is sufficiently frangible to ensure that it creates only a minor obstacle to a shock wave starting from any point of detonation, whereby the containing sheath of the nearest turn of detonating cord will be destroyed before the detonation front reaches the nearest turn of detonating cord as the detonation front moves along the cord.

A package according to the invention can be made up on a conventional reel, and thus on a reel which satisfies safety regulations, by using alternating coiled layers, with one type of layer being made up solely of touching turns of the intermediate spacer cord, while layers of the other type are constituted by alternating turns of spacer cord and detonating cord. It is thus possible to achieve a distance between the turns of detonating cord as specified above for obtaining the desired result of preventing detonation of the entire cord.

The invention will be better understood from the following description of several embodiments of the invention.

Reference is made to the accompanying drawings, in which.

Figure 1:
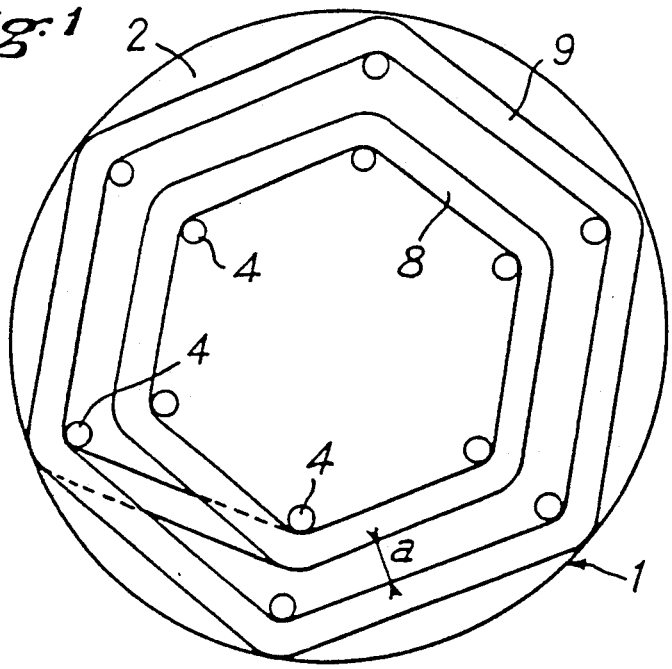
FIG. 1 is a diagrammatic radial section through a reel of detonating cord made in accordance with the invention.
Figure 2:
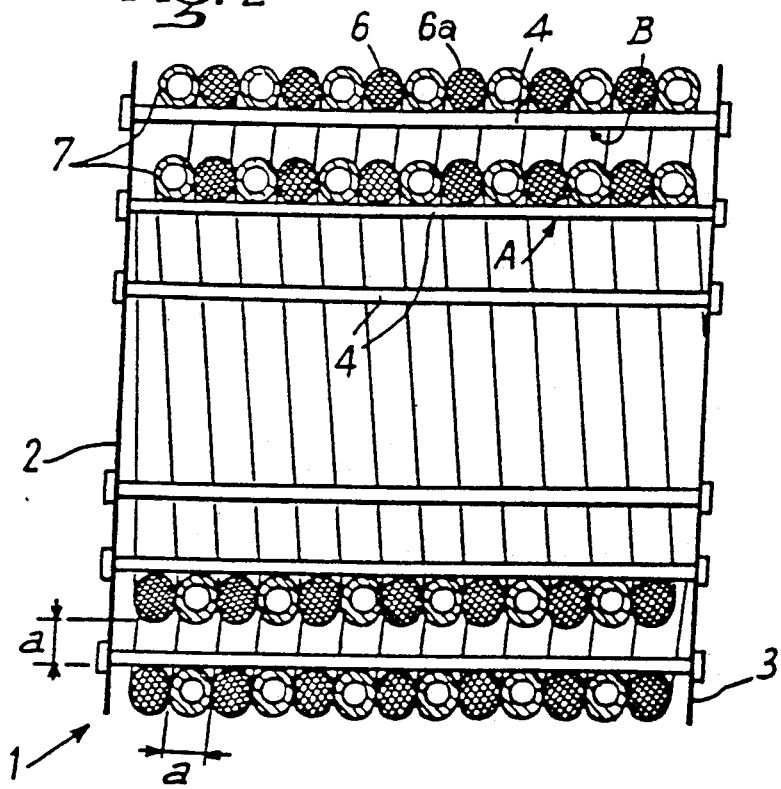
FIG. 2 is an axial section through a reel similar to that shown in FIG. 1.

With reference initially to FIGS. 1 and 2, a reel 1 can be seen comprising two end plates 2 and 3 spaced apart by two series A and B of strips 4. Each series A, B of strips constitutes a support on which alternating touching turns of detonating cord 6 and tubular spacer cord 7 are wound. The function of the spacer cord 7 is to maintain the spacing (a) between adjacent turns of detonating cord 6. In addition, the radial spacing between two series A and B of strips serves to maintain successive layers 8 and 9 similarly spaced apart by a distance which is approximately equal to (a). By this particular mode of winding, it is ensured that any portion of the detonating cord is at a distance (a) from the nearest parallel portion such that the distance (a) lies between the distance below which detonation would propagate from one portion of the detonating cord to another and the distance beyond which the containing sheath *6a*, which surrounds the explosive material of the cord, is not destroyed. It will be recalled that detonating cords are generally constituted by an explosive protected by a sheath which includes a braid of jute cloth surrounded by a layer of plastic material, e.g. nylon, which forms the outer portion of the sheath.

Naturally, the distance (a) varies in accordance with the nature and the diameter of the detonating cord, and it may be established experimentally.

By way of example, for flexible transmission cords used in mines, quarries, and oil wells, this distance is about 5 millimeters to 10 millimeters. The tubular cord 7 which maintains the spacing between the turns of detonating cord is thus a tube of plastic (e.g. polyvinyl chloride) having an outside diameter of about 5 millimeters and an inside diameter of about 3 millimeters.

The strips 4 are made of any suitable material (e.g. wood), and they are in such number that the layers are adequately supported. The end plates and the strips may constitute returnable packaging or non-returnable packaging. In any event, means need to be provided for enabling the strips other than those belonging to the innermost series A to be fixed to the end plates so as to enable the various layers to be wound. A layer can only be wound so long as the strips for supporting layers further out than the layer being wound are absent. Any appropriate type of fixing means may be used, including dismountable types and types which are not dismountable, depending on whether or not the support constitutes returnable packaging. Thus, for example, the side plates 2 and 3 may have radial grooves for receiving strips 4 provided with retaining heads and grooves at their ends.

Figure 3:
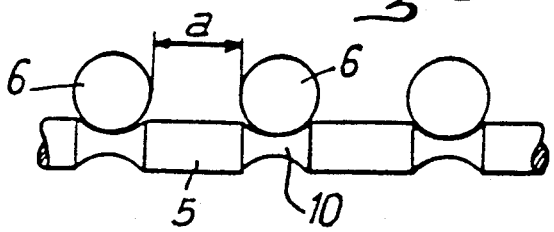
FIG. 3 shows a variant embodiment of the strip used in the preceding figures.

FIG. 3 shows a variant 5 of the strip 4 which includes notches 10 for enabling cord 6 to be wound in non-touching turns which are spaced apart by the distance (a) without it being necessary to use intermediate turns of spacer cord.

Figure 4:
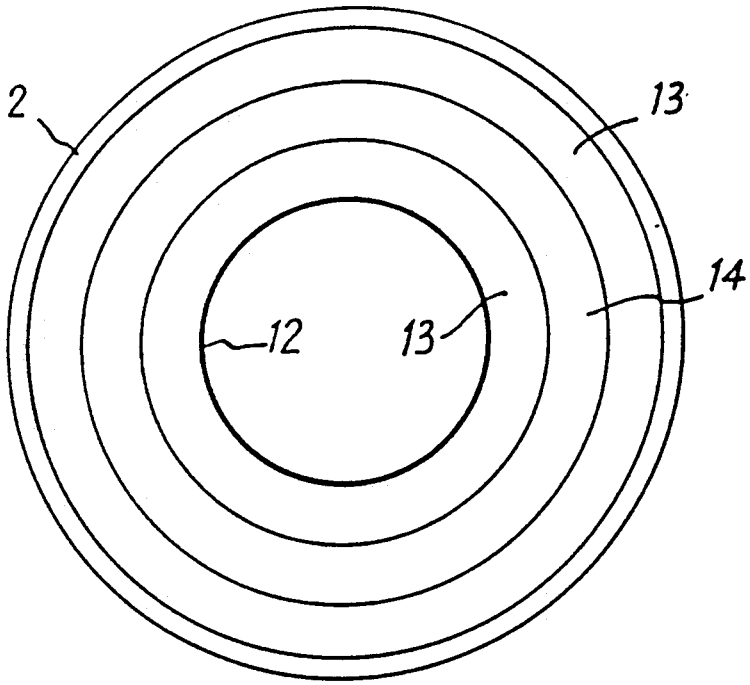
FIGS. 4 and 5 are a radial section and an axial section through a second reel made in accordance with the invention.
Figure 5:
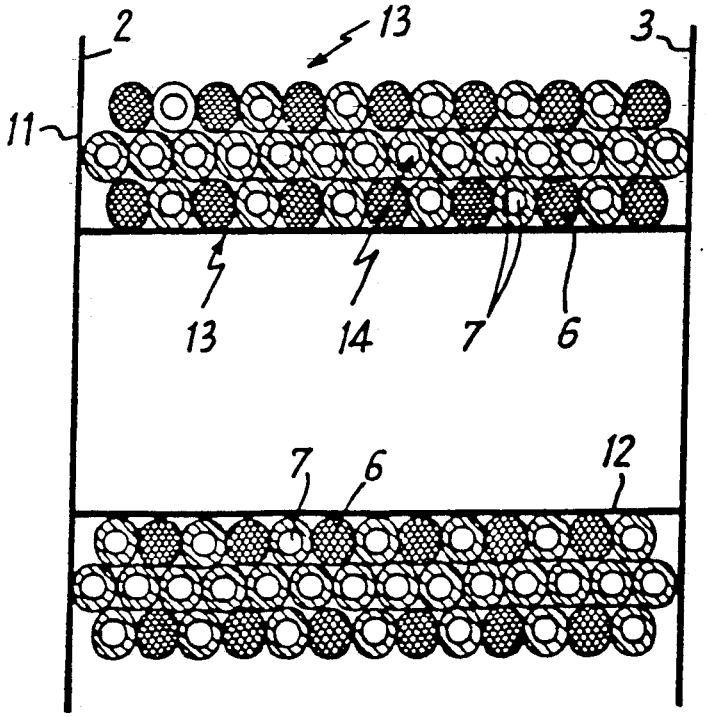

FIGS. 4 and 5 show that a substantially equivalent result can be obtained using a conventional reel 11 including a mandrel 12. The detonating cord 6 is wound together with hollow spacer cord 7 in such a manner as to ensure that adjacent turns of detonating cord are separated by intermediate turns of spacer cord, and that adjacent layers 13 including detonating cord are separated by intermediate layers 14 constituted by touching turns of spacer cord only.

What is claimed is:

1. A method of packaging a detonating cord comprising explosive material contained in a sheath, said method comprising the step of winding the detonating cord on a support in such a manner that every portion of the detonating cord in the winding , is spaced apart from the nearest portions which are substantially parallel thereto by a distance (a) lying in a range between the distance below which detonation is transmissible from one portion to the nearest portion, and the distance beyond which said containing sheath is no longer destroyed by the detonation of a nearest portion.

2. A method according to claim 1, wherein in order to maintain the above-mentioned spacing at least between adjacent portions of detonating cord in the same layer, the detonating cord is wound with intermediate turns of a spacer cord whose diameter is related to the value (a) desired for the spacing.

* * * * *